US009818524B2

(12) United States Patent
Vaesen

(10) Patent No.: US 9,818,524 B2
(45) Date of Patent: Nov. 14, 2017

(54) COUPLING ELEMENT FOR DIFFERENTIAL HYBRID COUPLER

(71) Applicant: IMEC VZW, Leuven (BE)

(72) Inventor: Kristof Vaesen, Mortsel (BE)

(73) Assignee: IMEC VZW, Leuven (BE)

( * ) Notice: Subject to any disclaimer, the term of this patent is extended or adjusted under 35 U.S.C. 154(b) by 0 days.

(21) Appl. No.: 15/185,536

(22) Filed: Jun. 17, 2016

(65) Prior Publication Data

US 2016/0379744 A1 Dec. 29, 2016

(30) Foreign Application Priority Data

Jun. 26, 2015 (EP) ..... 15174125

(51) Int. Cl.

| | |
|---|---|
| ***H01F 5/00*** | (2006.01) |
| ***H01F 27/28*** | (2006.01) |
| ***H01F 19/04*** | (2006.01) |
| ***H01P 5/02*** | (2006.01) |
| ***H01P 5/12*** | (2006.01) |
| ***H01P 5/18*** | (2006.01) |

(52) U.S. Cl.

CPC ..... *H01F 19/04* (2013.01); *H01F 27/2804* (2013.01); *H01P 5/028* (2013.01); *H01P 5/12* (2013.01); *H01P 5/185* (2013.01); *H01P 5/187* (2013.01)

(58) Field of Classification Search

None

See application file for complete search history.

(56) References Cited

U.S. PATENT DOCUMENTS

| | | | | |
|---|---|---|---|---|
| 6,608,364 | B2 * | 8/2003 | Carpentier | H01L 27/08 257/528 |
| 6,759,937 | B2 * | 7/2004 | Kyriazidou | H01F 17/0013 257/E21.022 |
| 6,801,114 | B2 * | 10/2004 | Yang | H01F 17/0013 336/200 |
| 8,400,232 | B2 * | 3/2013 | Leong | H01P 5/10 333/25 |
| 2002/0113682 | A1 * | 8/2002 | Gevorgian | H01F 17/0013 336/200 |

(Continued)

OTHER PUBLICATIONS

Frye, Robert C. et al., "A 2-GHz Quadrature Hybrid Implemented in CMOS Technology", IEEE Journal of Solid-State circuits, vol. 38, No. 3, Mar. 2003, pp. 550-555.

(Continued)

*Primary Examiner* — Ronald Hinson

(74) *Attorney, Agent, or Firm* — McDonnell Boehnen Hulbert & Berghoff LLP

(57) ABSTRACT

A coupling element is disclosed, comprising four coils that are arranged such that each one of the coils extends both in a first layer and a second layer. The first layer and the second layer are stacked with respect to each other and separated by an intermediate dielectric layer. The layout of each layer is configured to provide a transformer coupling between a first one and a third one of the coils, and between a second one and a fourth one of the coils. Further, the first coil and the second coil, and the third coil and the fourth coil, respectively, are routed so as to allow a differential signaling. A semiconductor device and a differential hybrid coupler comprising the coupling element are also disclosed.

20 Claims, 3 Drawing Sheets

(56) References Cited

U.S. PATENT DOCUMENTS

| | | | | |
|---|---|---|---|---|
| 2007/0244269 | A1* | 10/2007 | Bossaerts | C03C 25/36 525/527 |
| 2010/0060375 | A1* | 3/2010 | Chen | H01P 5/10 333/25 |
| 2010/0060402 | A1* | 3/2010 | Chen | H03H 7/422 336/200 |
| 2011/0148733 | A1* | 6/2011 | Fahs | H01F 17/0006 343/859 |
| 2012/0274434 | A1* | 11/2012 | Lim | H01L 23/5227 336/200 |

OTHER PUBLICATIONS

Shi, Qixian et al., "A 54-69.3 GHz Dual-Band VCO With Differential Hybrid Coupler for Quadrature Generation", 2013 IEEE Asian Solid-State Circuits Conference (A-SSCC), Nov. 2013, pp. 325-328.

* cited by examiner

COUPLING ELEMENT FOR DIFFERENTIAL HYBRID COUPLER

CROSS-REFERENCE TO RELATED APPLICATIONS

The present application is a non-provisional patent application claiming priority to European Patent Application No. EP 15174125.3, filed Jun. 26, 2015, the contents of which are hereby incorporated by reference.

FIELD OF THE DISCLOSURE

The present disclosure relates to a coupling element for couplers and power dividers, and in particular to a differential coupling element arranged in a first layer and a second layer that are separated from each other by an intermediate dielectric layer. The present disclosure also relates to a semiconductor device comprising such coupling element, and to a differential hybrid coupler comprising such coupling element and a termination resistor.

BACKGROUND

Coupling elements include different types of couplers and power dividers in which input electromagnetic power is split to multiple different output ports. In, e.g., R. C. Frye et al., A 2 GHz Quadrature Hybrid Implemented in CMOS Technology, IEEE JSSC, vol. 38, no. 3, pp. 550-555, March 2003, the input signal is split into two signals that are 90 degrees apart in phase. The frequency at which these and other couplers operate has allowed them to be miniaturized and integrated on-chip, and there is a still growing interest in further reducing the size or footprint of couplers implemented in, e.g., wireless communication systems.

There is also a general tendency in chip design to reduce the supply voltage. A drawback with lower supply voltages is however that the noise immunity of the circuits may be impaired, which may reduce the signaling quality. Q. Shi et. al., A 54-69.3 GHz Dual-Band VCO with Differential Hybrid Coupler for Quadrature Generation, Solid-State Circuits Conference (A-SSCC), 2013 IEEE Asian, pp. 325,328, 11-13 November 2013, provides differential signaling by connecting two single ended quadrature hybrids. Such a duplicated quadrature hybrid however requires a relatively large area and may increase the footprint of the circuit.

There is hence a need for a coupler that has a relatively small footprint and that is less sensitive to noise, e.g. external noise and/or noise induced from the power supply and/or neighboring circuits.

SUMMARY

An object of at least some of the embodiments of the present disclosure is to provide a coupling element that is less sensitive to noise and has a relatively small footprint.

At least one of this and other objects of the present disclosure is achieved by means of a coupling element having the features defined in the independent claim. Additional embodiments of the disclosure are characterized by the dependent claims.

According to a first aspect of the present disclosure, a coupling element is provided that comprises four coils and is arranged in a first layer and a second layer. The first layer and the second layer are separated from each other by an intermediate dielectric layer. The first coil is arranged such that at least one turn extends in the first layer and another turn extends in the second layer. Similarly, the second coil is arranged such that at least one turn extends in the first layer and another turn extends in the second layer. The at least one turn of the second coil arranged in the first layer is further arranged along at least a portion of the first coil arranged in the first layer, wherein the another turn of the second coil arranged in the second layer is arranged along at least a portion of the first coil arranged in the second layer. The third coil is arranged such that at least one turn of the third coil extends in the first layer and superposes at least a portion of the first coil arranged in the second layer, and such that another turn of the third coil extends in the second layer and is superposed by at least a portion of the first coil arranged in the first layer. The fourth coil is arranged such that at least one turn of the fourth coil extends in the first layer and superposes at least a portion of the second coil arranged in the second layer, and such that another turn of the fourth coil extends in the second layer and is superposed by at least a portion of the second coil arranged in the first layer.

A "turn" should be understood as a portion of a conductive track or trace forming a part of the coil and extending in a given plane of the coupling element. The turn may extend along a curve starting and ending on a same side of a plane laterally dividing the coupling element in two halves. In some embodiments, the turn may extend along a curve making at least a 180° turn or loop. In other embodiments, the curve may make a full 360° turn. The curve along which the track of the coil extends may be formed as a spiral starting at a first radial distance from a center of the coupling element and ending at a second radial distance from the center point.

By arranging the coils of the coupling element in two separate layers arranged above each other, the footprint or total area of the coupling element may be reduced, which hence allows for more compact devices and circuits to be provided.

Further, by arranging the coils such that the first coil extends at least partly along the second coil in the same plane, i.e., along, abreast, or parallel with the second coil in the first layer and the second layer, respectively, a parasitic capacitance, or shunt capacitance, may be provided between the conductors or traces of the first coil and the second coil. The first coil and the second coil may be provided with a differential signal, wherein two complementary signals are transmitted through the first and second coils, respectively.

The first coil and the second coil may be routed in opposite directions in relation to each other, i.e., such that a signal in the first coil and a signal in the second coil during operation are transferred in opposite directions relative to each other. A magnetic field generated by the first coil may thereby be prevented from counteracting a magnetic field generated by the second coil, and vice versa, during differential operation of the coupling element.

Similarly, arranging the third coil such that it in a given plane extends at least partly along or abreast the fourth coil in the same plane, respectively, a parasitic capacitance may be provided between the conductors or traces of the first coil and the second coil. The third coil and the fourth coil may, just as the first and second coils, be routed in opposite directions to each other so as to not counteract a magnetic field generated by the third coil and the fourth coil, respectively, during differential operation.

In an example embodiment, an electromagnetic interaction may also be achieved between the first coil and the third coil extending above or along each other in separate planes, i.e., between the first coil in the first layer and the third coil in the second layer, and vice versa.

The electromagnetic interaction between two coils that are separated from each other by the intermediate dielectric layer may hence provide a transformer coupling between said coils. Thus, a transformer coupling may be provided between the first coil and the third coil. Similarly, a transformer coupling may be provided between the second coil and the fourth coil.

It will be appreciated that the parasitic capacitance between neighboring or adjacent portions of the conductors or coils may be determined by the dielectric constant of the material arranged between the respective conductors, the distance between the conductors, and the shape and/or area of the conductors.

By varying one or several of those parameters, such as, e.g., the track width or track spacing of the coils, the parasitic capacitance between coils extending in the same plane may be adapted so as to provide a desired shunt capacitance without using additional shunt capacitors. Further, the track width, distance, or dielectric constant between superposing coils may be modified so as to provide a desired coupling capacity without using additional coupling capacitors.

In one example, the dielectric constant of the intermediate layer and the distance between the first layer and the second layer may be given by the technology wherein the coupling element is implemented, and may therefore be difficult to modify or vary. In such cases, the coupling capacitance, e.g. the parasitic capacitance between the first coil and the third coil (and the second coil and the fourth coil, respectively), may be determined by the width of the conducting traces forming the respective coils. Increasing the width of the traces may increase the coupling capacitance, whereas reducing the width may result in a reduced coupling capacitance.

According to an embodiment, the coupling element may comprise four ports that are formed by electrical terminals of the coils: a differential input port, a differential through port, a differential coupled port, and a differential isolated port. The differential input port may be formed by a first terminal of the first coil and a first terminal of the second coil, the differential through port by a second terminal of the first coil and a second terminal of the second coil, a differential coupled port by a second terminal of the third coil and a second terminal of the fourth coil, and a differential isolated port by a first terminal of the third coil and a first terminal of the fourth coil. During operation, at least a portion of the power applied to the differential input port may be transmitted to the differential through port, at which the transmitted power may be output. Further, a portion of the input power may also be transmitted or coupled to differential coupled port, at which the coupled power may be output at a phase difference. The isolated port may be terminated with a matched load so as to provide a directional coupler.

According to an embodiment, the differential input port and the differential through port may be arranged on a first side of the coupling element, whereas the differential coupled port may be arranged on a second side of the coupling element. The differential isolated port may also be arranged on the second side of the coupling element. The first side and the second side of the coupling element may be different and arranged so as to facilitate or simplify the layout of the circuit in which the coupling element is used.

In one embodiment, the first side and the second side may be arranged opposite to each other so as to facilitate a cascade or chain connection of several coupling elements.

It will be appreciated that the coils may be routed such that an inner periphery of the coupling element conforms to a polygon, such as a rectangle, square, or octagon, or a ring shape such as a circle or oval.

According to an embodiment, at least one of the first coil, the second coil, the third coil, and the fourth coil may comprise a via connection for electrically connecting the at least one turn in the first layer with said another turn in the second layer, respectively. The via connection may hence provide an electrical connection between electrically conducting traces in the first layer and the second layer, thus allowing an electrical signal to be conducted through the intermediate dielectric layer. The coil may extend in a generally spiral fashion such that a terminal of the coil is arranged on an outside portion of the coupling element and the via connection within the coupling element.

According to a second aspect, a semiconductor device is provided, comprising a coupling element according to the first aspect. As the coupling element may be arranged in two conducting layers, on-chip integration of the coupling element may be implemented by using only two metal layers of the semiconductor device for forming the first layer and the second layer of the coupling element. For a high quality of the performance of the coupling element, the electrical resistance of the conductors of the coils may be as low as possible. Metal layers may therefore be well suited for this.

According to some embodiments, the coupling element may be implemented in a monolithic microwave integrated circuit, MMIC, or a complementary metal oxide semiconductor, CMOS, integrated circuit. The power and/or ground layers may be used as the first and the second layers of the coupling device. As the power and/or ground layers in standard CMOS technology may be thicker than the other metal layers, tracks of a given width may have less electrical resistance in these thicker layers and may therefore provide a coupling element having improved electrical characteristics.

According to a third aspect, a differential hybrid coupler is provided, comprising a coupling element according to the first aspect. The differential hybrid coupler further comprises a termination resistor that is connected to the differential isolated port formed by the first terminal of the third coil and the first terminal of the fourth coil. The differential hybrid coupler may be designed to provide a 3 dB coupling, but other coupling values (e.g., 10 dB) may be also provided depending on the required specification. The phase difference between the differential through port and the differential coupled port may, e.g., be 90 degrees such that the differential coupled port is in quadrature phase with the differential through port. A differential quadrature coupler thereby may be provided.

As already mentioned, the coils of the coupling element according to the first aspect may be formed of electrical conductors having a track width and/or spacing that is adapted to provide a desired coupling capacitance and/or shunt capacitance. However, the differential hybrid coupler may also be provided with additional capacitors. According to an embodiment, the differential hybrid coupler may comprise a first set of coupling capacitors that is connected between the differential input port and the differential coupled port, and a second set of coupling capacitors that is connected between the differential through port and the differential isolated port so as to provide a desired coupling capacitance. In one example, the first set of coupling capacitors may comprise a capacitor connected between the first terminal of the first coil and a second terminal of the third coil, and another capacitor connected between the first terminal of the second coil and the second terminal of the fourth coil. The second set of coupling capacitors may comprise a capacitor connected between the second terminal of the first coil and the first terminal of the third coil, and another capacitor connected between the second terminal of the second coil and the first terminal of the fourth coil.

Further, a shunt capacitor may be provided between the terminals of each respective port. For example, a first shunt capacitor may be connected between the terminals of the differential input port, i.e., the first terminal of the first coil and the first terminal of the second coil. Similarly, a second shunt capacitor may be connected between the terminals of the differential through port, i.e. the second terminal of the first coil and the second terminal of the second coil, a third shunt capacitor may be connected between the terminals of the differential coupled port, i.e. the second terminal of the third coil and the second terminal of the fourth coil, and, a fourth capacitor may be connected between terminals of the differential isolated port, i.e. the first terminal of the third coil and the first terminal of the fourth coil, so as to provide a desired shunt capacity.

Further objectives of, features of, and advantages with the present disclosure will become apparent when studying the following detailed disclosure, the drawings, and the appended claims. Those skilled in the art realize that different features of the present disclosure, even if recited in different claims, can be combined in embodiments other than those described in the following.

DETAILED DESCRIPTION

The present disclosure will now be described hereinafter with reference to the accompanying drawings, in which embodiments of the disclosure are shown. This disclosure may, however, be embodied in many different forms and should not be construed as limited to the embodiments set forth herein.

Figure 1:
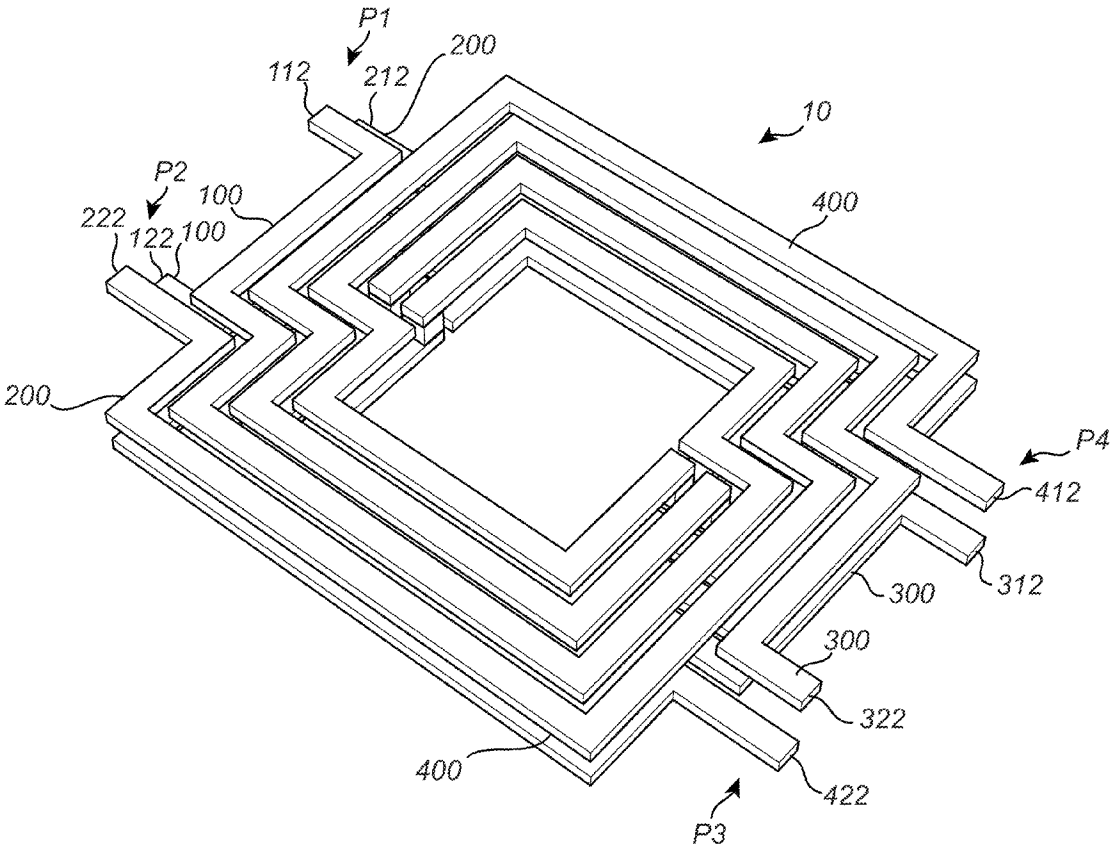
FIG. 1 is a perspective view of a coupling element arranged in a first layer and a second layer, according to example embodiments.

With reference to FIG. 1, there is shown a perspective view of a coupling element 10 according to an embodiment of present disclosure. The coupling element may comprise four coils 100, 200, 300, 400, each of which having at least two turns extending in a first layer and a second layer, respectively.

Figure 4:
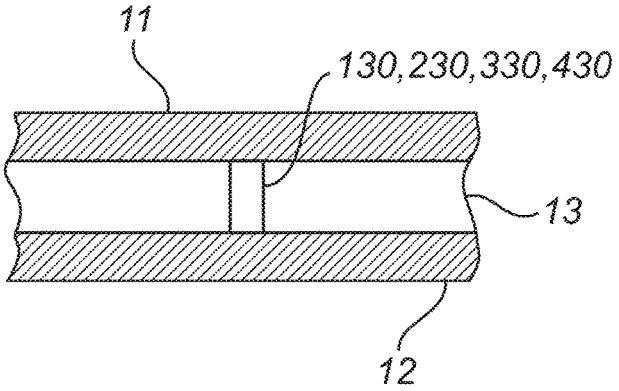
FIG. 4 is a schematic cross-section of a portion of the layers of a coupling element, according to example embodiments.

As indicated in FIG. 1, the first coil 100 comprises a first terminal 112 and a second terminal and may be arranged such that at least one turn 110, forming a part of the coil 100, extends in the first layer and at least another turn 120 extends in the underlying, second layer. The first and second layers, and hence the respective turns 110, 120 of the first coil 100, may be separated from each other by an intermediate dielectric layer as shown in FIG. 4.

According to the present embodiment, the first terminal 112 and the second terminal 122 of the first coil 100 may be arranged on a same side of the coupling element 10 such that, during operation of the coupling element 10, power that is input at, e.g., the first terminal 112 may be output at the same side of the coupling element 10.

The second coil 200 may be similarly arranged as the first coil 100, extending in the first layer and the second layer and having a first terminal 212 and a second terminal 222. Further, the second coil 200 may be arranged such that at least one turn 210 of the second coil 200 extends in the first layer and along at least a portion of the first coil 100, i.e., along, or side by side with, at least a portion of the at least one turn 110 arranged in the first layer. Further, another turn 220 of the second coil may be arranged to extend in the second layer and along at least a portion of the first coil 100, i.e., along at least a portion of the turn 120 of the first coil 100 arranged in the second layer.

By arranging the first coil 100 and the second coil 200 such that the first terminal 112 of the first coil 100 is connected to the turn 110 of the first coil 100 that extends in the first layer, and such that the first terminal 212 of the second coil 200 is connected to the turn 220 of the second coil 200 that extends in the second layer, the first coil 100 and the second coil 200 can be described as two oppositely routed coils. Accordingly, the second terminal 122 of the first coil 100 is connected to the turn 120 of the first coil 100 that extends in the second layer, whereas the second terminal 222 of the second coil 200 is connected to the turn 220 of the second coil 200 that extends in the first layer. By arranging the second coil 200 such that it at least partly extends along the first coil 100 in a same plane, a parasitic capacitance, or shunt capacitance, between the first coil 100 and the second coil 200 may be used to provide or modify a characteristic impedance of the coupling element. Further, as a signal is provided at the first terminal 112 and the second terminal 212, the opposite routing of the first coil 100 and the second coil 200 allows for a differential signaling; wherein the electromagnetic fields that are generated by the complementary signals are directed in the same direction, thereby avoiding, or at least reducing, the risk of the magnetic fields cancelling or counteracting each other.

The third coil 300 and the fourth coil 400 may be similarly arranged as the first coil 100 and the second coil 400. As indicated in FIG. 1, at least one turn 310 of the third coil 300 may be arranged to extend in the first layer and such that it superposes at least a portion 120 of the first coil arranged in the second layer. Further, another turn 320 of the third coil is arranged to extend in the second layer and to superpose at least a portion 110 of the first coil 100 arranged in the first layer. By arranging the third coil 300 such that it at least partly superposes the first coil 100, i.e., such that the first coil 100 and the third coil 300 are arranged in a stacked arrangement in relation to each other, an electromagnetic interaction may be provided. The electromagnetic interaction may allow for a transformer action between the first coil 100 and the third coil 300. The third coil 300 may have a first terminal 312 connected to the turn 320 of the third coil 300 that is arranged in the second layer, and a second terminal 322 connected to the turn 310 of the third coil 300 that is arranged in the first layer.

The fourth coil 400 may comprise at least one turn 410 that is arranged to extend in the first layer and such that it superposes at least a portion 220 of the second coil 200 arranged in the second layer, and at least one turn 420 that is arranged to extend in the second layer and such that it is superposed by at least a portion 210 of the second coil 200 arranged in the first layer. Further, the fourth coil 400 may comprise a first terminal 412 that is connected to the turn 410 arranged in the first layer, and a second terminal 422 that is connected to the turn 420 arranged in the second layer. Similarly to what is described above in connection to the third coil 300, a transformer coupling may be provided between the fourth coil 400 and the second coil 200.

As the third coil 300 and the fourth coil 400 may be routed or operated in opposite direction, they may be used for differential signaling in a similar way as described with reference to the first coil 100 and the second coil 200.

The coupling element 10 may further comprise a differential input port P1 that is formed by the first terminal 112 of the first coil 100 and the first terminal 212 of the second coil 200. The second terminal 122 of the first coil 100 and the second terminal 222 of the second coil 200 may form a differential through port P2, wherein the differential input port P1 and the differential through port P2 may be arranged on the same side of the coupling element 10. Similarly, the first terminal 312 of the third coil 300 and a first terminal 412 of the fourth coil 400 may form a differential isolated port P4, whereas the second terminal 322 of the third coil 300 and a second terminal 422 of the fourth coil 400 may form a differential coupled port P3.

Figure 2:
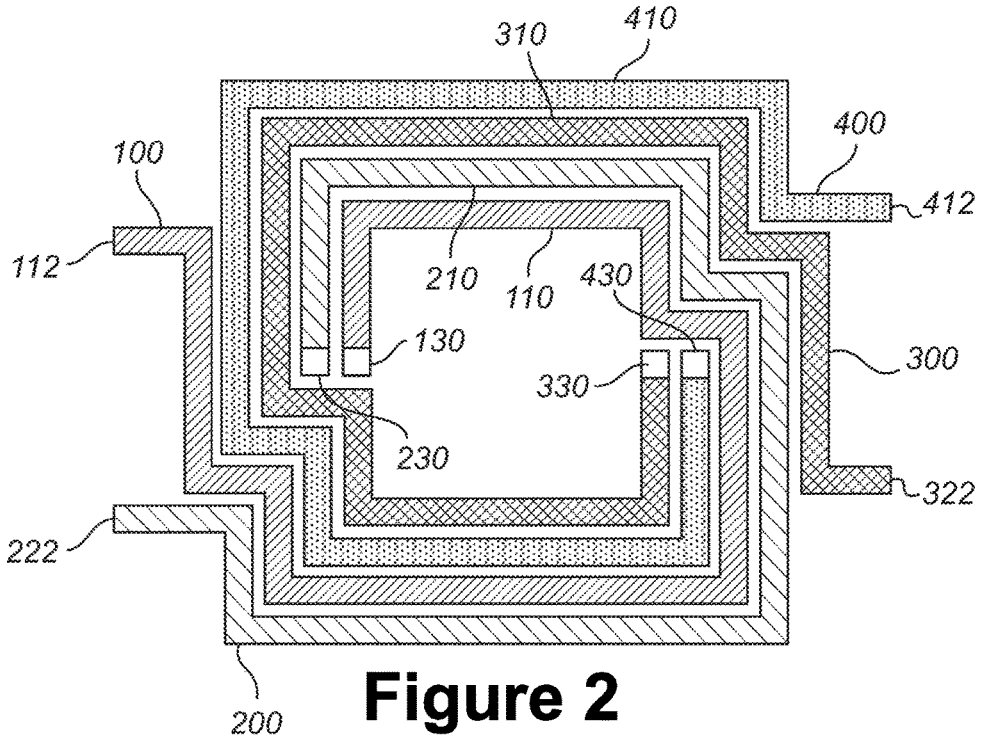
FIG. 2 is a schematic layout of the turns of a coupling element arranged in the first layer, according to example embodiments.

FIG. 2 is a schematic illustration of the layout or routing of a coupling element 10 in the first layer. The coupling element 10 may be similarly configured as the coupling element 10 discussed in connection with FIG. 1. As shown in FIG. 2, the first layer of the present embodiment may comprise one turn 112, 212, 312, 412 of each one of the first coil 100, second coil 200, third coil 300, and fourth coil 400, respectively. The turn 110 of the first coil 100 starts at the first terminal 112, arranged at a first side of the coupling element, and ends, after a, e.g., counter-clockwise turn, at a first via connection 130 arranged within the coupling element 10 and at a same side of a center point of the coupling element as the first side. The turn 210 of the second coil 200 may start at a second via connection 230, which may be arranged adjacent to the first via connection 130, and extend clockwise along the turn 110 of the first coil 100 to a second terminal 222 of the second coil 200, arranged at the same side of the coupling element 10 as the first terminal 122 of the first coil 100.

Similarly, the turn 410 may, according to this embodiment, start at the first terminal 412 of the fourth coil 400 and end, after a counter clockwise turn, at a fourth via connection 430 arranged within the coupling element 10. Adjacent to the fourth via connection 430, a third via connection 430 may be arranged from which the turn 310 of the third coil 300 may extend clockwise to the second terminal 322 of the third coil 300, wherein the second terminal 322 may be arranged at the same side of the coupling element 10 as the first terminal 412 of the fourth coil 400. In this embodiment, the first terminal 412 of the fourth coil 400 and the second terminal 322 of the third coil 300 may be arranged at a second side of the coupling element 10, wherein the second side may be opposite to the first side.

The via connections 130, 230, 330, 430 may be configured to electrically connect the portions of the coils 100, 200, 300, 400 in the first layer with the portions of the coils 100, 200, 300, 400 in the second layer.

Figure 3:
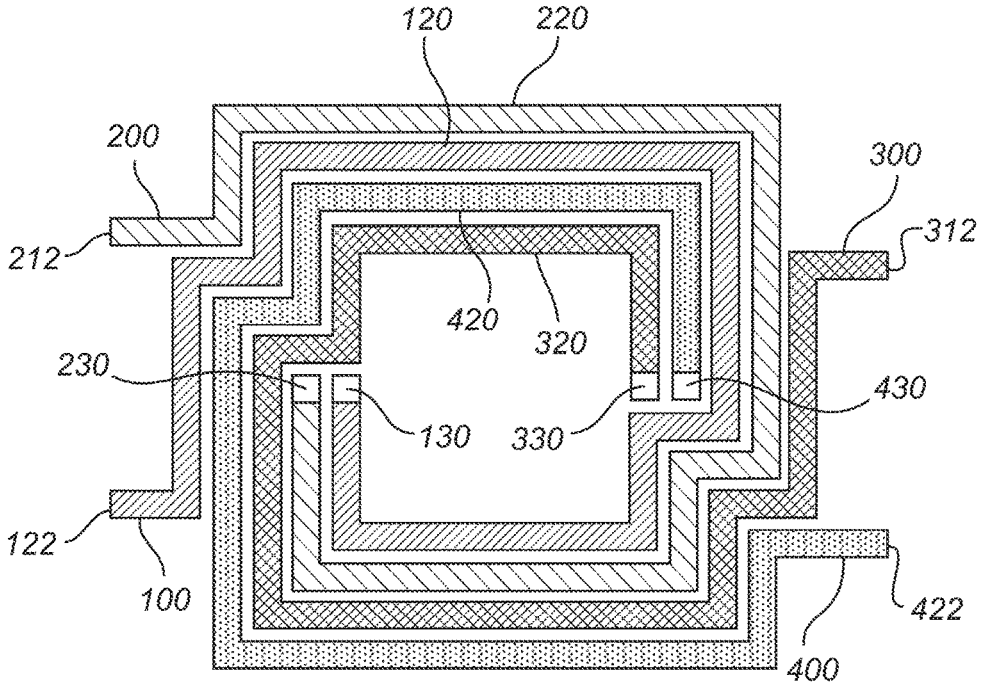
FIG. 3 is a schematic layout of the turns of a coupling element arranged in the second layer, according to example embodiments.

An example of such a second layer of a coupling element is shown in FIG. 3. The embodiment in FIG. 3 may be similarly configured as the coupling elements described with reference to FIGS. 1 and 2. As shown in FIG. 3, the turn 120 of the first coil 100 starts at the via 130 and continues counterclockwise to the second terminal 122 of the first coil 100, the turn 220 starts at the first terminal 212 of the second coil 200 and continues clockwise along the turn 120 of the first coil 100 to the via connection 230, the turn 320 of the third coil 300 starts at the first terminal 312 of the third coil 300 and continues clockwise to the third via connection 330, and the turn 420 of the fourth coil 400 starts at the fourth via connection 430, adjacent to the third via connection 330, and continues counterclockwise to the second terminal 422 of the fourth coil 400.

As shown in FIGS. 1-3, the tracks forming the turns of the coils 100, 200, 300, 400 in each layer may extend along a spiral allowing the terminals to be connected from outside of the coupling element 10 and the via connections 130, 230, 330, 430 to be arranged within the coupling element 10.

FIG. 4 is a schematic cross section of a portion of a coupling element that may be similarly configured as any one of the previously described embodiments. As illustrated in FIG. 4, the coupling element may be arranged in a stacked configuration wherein each coil (not shown in FIG. 4) may be arranged such that at least one turn extends in the first layer 11 and at least another turn extends in a second layer 12. The layers may be separated from each other by a dielectric intermediate layer 13. Further, a via connection 130, 230, 330, 430 may extend through the intermediate layer 13 so as to allow for an electrical connection between the first layer 11 and the second layer 12. In some embodiments, the first layer 11 and the second layer 12 may be metal layers, or conducting layers, of an integrated circuit.

Figure 5:
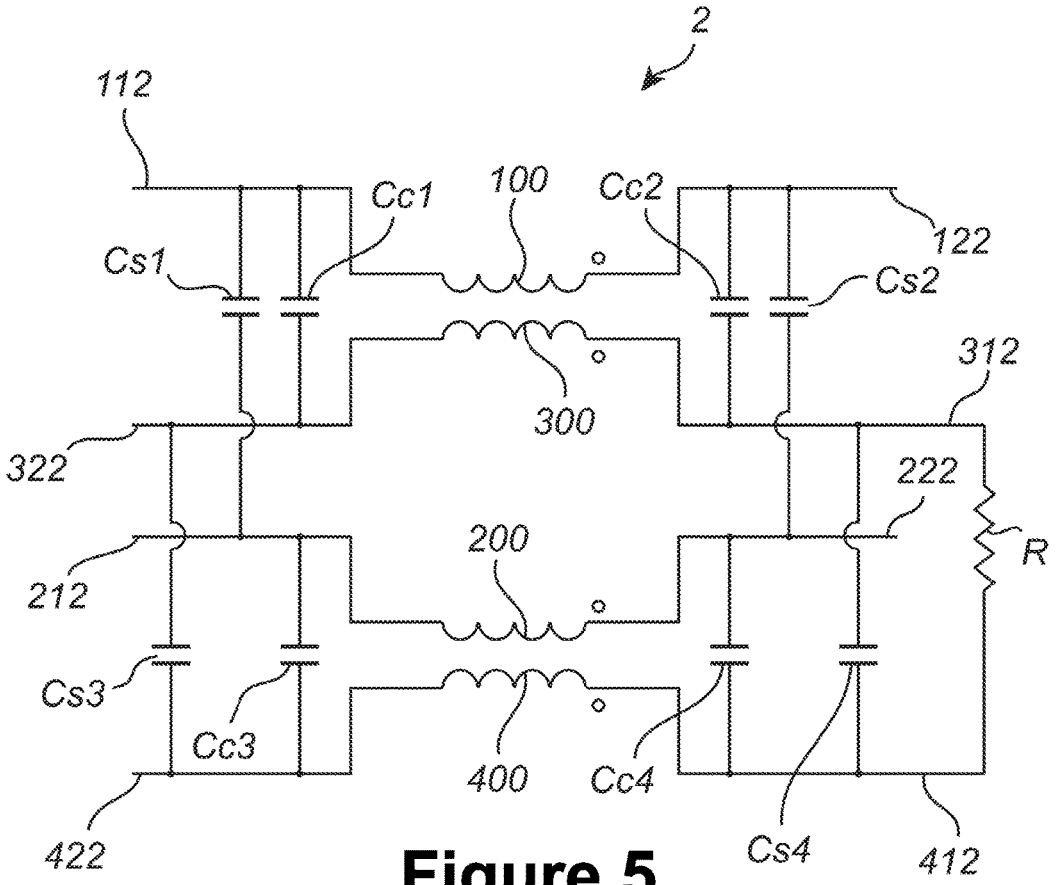
FIG. 5 is a symbolic representation of a semiconductor device, such as a differential hybrid coupler, according to example embodiments.

FIG. 5 is a symbolic representation of a semiconductor device, such as a differential hybrid coupler, comprising a coupling element 10 according to any one of the embodiments described with reference to FIGS. 1-4. The coupling element comprises a differential input port P1, a differential through port P2, a differential coupled port P3 and a differential isolated port P4 as previously described.

According to the present embodiment, the differential hybrid coupler may comprise a termination resistor R, or matched load, that is connected to the differential isolated port P4. Further, coupling capacitors Cc1, Cc2, Cc3, Cc4 may be arranged at one or several of the differential input port P1, the differential through port P2, the differential coupled port P3, and the differential isolated port P4. A first coupling capacitor Cc1 may be connected between the first terminal 112 of the first coil 100 and a second terminal 322 of the third coil 300, a second coupling capacitor Cc2 connected between the second terminal 122 of the first coil 100 and the second terminal 322 of the third coil 300, a third coupling capacitor Cc3 connected between the first terminal 212 of the second coil 200 and the second terminal 422 of the fourth coil 400, and a fourth coupling capacitor Cc4 connected between the second terminal 222 of the second coil 200 and the first terminal 412 of the fourth coil 400.

Further, shunt capacitors Cs1, Cs2, Cs3, Cs4 may be provided between the terminals of one or several of the ports P1, P2, P3, P4. In one example, a first shunt capacitor Cs1 may be connected between the first terminal 112 of the first coil 100 and the first terminal 212 of the second coil 200, a second shunt capacitor Cs2 connected between the second terminal 122 of the first coil 100 and the second terminal 222 of the second coil 200, a third shunt capacitor Cs3 connected between the second terminal 322 of the third coil 300 and the second terminal 422 of the fourth coil 400, and a fourth shunt capacitor Cs4 connected between the first terminal 312 of the third coil 300 and the first terminal 412 of the fourth coil 400.

In conclusion, a coupling element is disclosed. The coupling element comprises four coils that are arranged such that each one of the coils extends both in a first layer and a second layer. The first layer and the second layer are stacked with respect to each other and separated by an intermediate dielectric layer. The layout of each layer is configured to provide a transformer coupling between a first one and a third one of the coils, and between a second one and a fourth one of the coils, respectively. Further, the first coil and the second coil, and the third coil and the fourth coil, respectively, are routed so as to allow a differential signaling. A semiconductor device and a differential hybrid coupler comprising the coupling element are also disclosed.

While the present disclosure has been illustrated and described in detail in the appended drawings and the foregoing description, such illustration and description are to be considered illustrative or exemplifying and not restrictive; the present disclosure is not limited to the disclosed embodiments. Other variations to the disclosed embodiments can be understood and effected by those skilled in the art in practicing the claimed disclosure, from a study of the drawings, the disclosure, and the appended claims. For example, the routing or traces of the coils may be provided in any suitable shape, conforming to, e.g., octagons or ring-shapes, and is not limited to the exemplifying embodiments disclosed in connection with the figures. Further, the number of turns of the coils may be varied, just as the position of the corresponding terminals.

The mere fact that certain measures are recited in mutually different dependent claims does not indicate that a combination of these measures cannot be used to advantage. Any reference signs in the claims should not be construed as limiting the scope.

What is claimed is:

1. A coupling element arranged in a first layer and a second layer that are separated from each other by an intermediate dielectric layer, the coupling element comprising:

a first coil arranged such that:

at least one turn of the first coil extends in the first layer, and another turn of the first coil extends in the second layer;

a second coil arranged such that:

at least one turn of the second coil extends in the first layer and along at least a portion of the first coil arranged in the first layer, and another turn of the second coil extends in the second layer and along at least a portion of the first coil arranged in the second layer;

a third coil arranged such that:

at least one turn of the third coil extends in the first layer and superposes at least a portion of the first coil arranged in the second layer, and another turn of the third coil extends in the second layer and superposes at least a portion of the first coil arranged in the first layer; and a fourth coil arranged such that:

at least one turn of the fourth coil extends in the first layer and superposes at least a portion of the second coil arranged in the second layer, and another turn of the fourth coil extends in the second layer and superposes at least a portion of the second coil arranged in the first layer.

2. The coupling element according to claim 1, further comprising:

a differential input port formed by a first terminal of the first coil and a first terminal of the second coil;

a differential through port formed by a second terminal of the first coil and a second terminal of the second coil;

a differential coupled port formed by a second terminal of the third coil and a second terminal of the fourth coil; and a differential isolated port formed by a first terminal of the third coil and a first terminal of the fourth coil.

3. The coupling element according to claim 2, wherein:

the differential input port and the differential through port are arranged on a first side of the coupling element; and the differential coupled port and the differential isolated port are arranged on a second side of the coupling element, wherein the first side of the coupling element and the second side of the coupling element are different sides of the coupling element.

4. The coupling element according to claim 3, wherein the first side of the coupling element and the second side of the coupling element are arranged opposite to each other.

5. The coupling element according to claim 1, wherein an inner periphery of the coupling element conforms to a polygon shape or a ring shape.

6. The coupling element according to claim 1, wherein at least one of the first coil, the second coil, the third coil, and the fourth coil comprises a via connection for electrically connecting the at least one turn in the first layer with the another turn in the second layer, respectively.

7. The coupling element according to claim 1, wherein the first coil, the second coil, the third coil, and the fourth coil are formed by metal traces.

8. A semiconductor device, comprising:

a coupling element arranged in a first layer and a second layer that are separated from each other by an intermediate dielectric layer, the coupling element comprising:

a first coil arranged such that:

at least one turn of the first coil extends in the first layer, and another turn of the first coil extends in the second layer;

a second coil arranged such that:

at least one turn of the second coil extends in the first layer and along at least a portion of the first coil arranged in the first layer, and another turn of the second coil extends in the second layer and along at least a portion of the first coil arranged in the second layer;

a third coil arranged such that:

at least one turn of the third coil extends in the first layer and superposes at least a portion of the first coil arranged in the second layer, and another turn of the third coil extends in the second layer and superposes at least a portion of the first coil arranged in the first layer; and a fourth coil arranged such that:

at least one turn of the fourth coil extends in the first layer and superposes at least a portion of the second coil arranged in the second layer, and another turn of the fourth coil extends in the second layer and superposes at least a portion of the second coil arranged in the first layer.

9. The semiconductor device according to claim 8, wherein the first layer and the second layer are metal layers.

10. The semiconductor device according to claim 8, wherein the coupling element is implemented in a monolithic microwave integrated circuit, MMIC.

11. The semiconductor device according to claim 8, wherein the coupling element is implemented in a complementary metal oxide semiconductor, CMOS, integrated circuit.

12. A differential hybrid coupler, comprising:

a coupling element arranged in a first layer and a second layer that are separated from each other by an intermediate dielectric layer, the coupling element comprising:

a first coil arranged such that:

at least one turn of the first coil extends in the first layer, and another turn of the first coil extends in the second layer;

a second coil arranged such that:

at least one turn of the second coil extends in the first layer and along at least a portion of the first coil arranged in the first layer, and another turn of the second coil extends in the second layer and along at least a portion of the first coil arranged in the second layer;

a third coil arranged such that:

at least one turn of the third coil extends in the first layer and superposes at least a portion of the first coil arranged in the second layer, and another turn of the third coil extends in the second layer and superposes at least a portion of the first coil arranged in the first layer; and a fourth coil arranged such that:

at least one turn of the fourth coil extends in the first layer and superposes at least a portion of the second coil arranged in the second layer, and another turn of the fourth coil extends in the second layer and superposes at least a portion of the second coil arranged in the first layer; and a termination resistor connected to a differential isolated port formed by a first terminal of the third coil and a first terminal of the fourth coil.

13. The differential hybrid coupler according to claim 12, wherein an inner periphery of the coupling element conforms to a polygon shape or a ring shape.

14. The differential hybrid coupler according to claim 12, wherein at least one of the first coil, the second coil, the third coil, and the fourth coil comprises a via connection for electrically connecting the at least one turn in the first layer with the another turn in the second layer, respectively.

15. The differential hybrid coupler according to claim 12, wherein the first layer and the second layer are metal layers.

16. The differential hybrid coupler according to claim 12, further comprising:

a differential input port formed by a first terminal of the first coil and a first terminal of the second coil;

a differential through port formed by a second terminal of the first coil and a second terminal of the second coil; and a differential coupled port formed by a second terminal of the third coil and a second terminal of the fourth coil.

17. The differential hybrid coupler according to claim 16, further comprising:

a first set of coupling capacitors connected between the differential input port and the differential coupled port; and a second set of coupling capacitors connected between the differential through port and the differential isolated port.

18. The differential hybrid coupler according to claim 16, further comprising:

a first shunt capacitor connected between the terminals of the differential input port, a second shunt capacitor connected between the terminals of the differential through port, a third shunt capacitor connected between the terminals of the differential coupled port, and a fourth shunt capacitor connected between the terminals of the differential isolated port.

19. The differential hybrid coupler according to claim 16, wherein the differential input port and the differential through port are arranged on a first side of the coupling element; and the differential coupled port and the differential isolated port are arranged on a second side of the coupling element, wherein the first side of the coupling element and second side of the coupling element are different sides of the coupling element.

20. The differential hybrid coupler according to claim 19, wherein the first side of the coupling element and the second side of the coupling element are arranged opposite to each other.

* * * * *